US006732451B2

(12) United States Patent
Conwell et al.

(10) Patent No.: US 6,732,451 B2
(45) Date of Patent: May 11, 2004

(54) UV CURING MODULE FOR LABEL PRINTER

(75) Inventors: Kevin Girard Conwell, Fairfield, OH (US); Matt Adams, Cincinnati, OH (US)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 10/120,620

(22) Filed: Apr. 11, 2002

(65) Prior Publication Data

US 2002/0174561 A1 Nov. 28, 2002

Related U.S. Application Data

(60) Provisional application No. 60/287,842, filed on May 1, 2001, and provisional application No. 60/283,113, filed on Apr. 11, 2001.

(51) Int. Cl.[7] ..... F26B 3/34

(52) U.S. Cl. ..... 34/275; 34/420; 101/491; 101/488; 101/424.1; 156/DIG. 49; 156/DIG. 43; 156/384; 156/379.6

(58) Field of Search ..... 34/275, 276, 266, 34/423, 420; 400/615.2; 101/483, 484, 487, 488, 424.1, 288, 228, 491; 156/DIG. 25, DIG. 49, 384, 387, 379.6, 380.9, 540, 542

(56) References Cited

U.S. PATENT DOCUMENTS

| | | | | | |
|---|---|---|---|---|---|
| 4,065,068 | A | * | 12/1977 | Treadwell | 242/67.1 |
| 4,164,423 | A | * | 8/1979 | Schumacher et al. | 106/20 |
| 4,798,960 | A | * | 1/1989 | Keller et al. | 250/504 R |
| 4,839,522 | A | * | 6/1989 | Bourgeois et al. | 250/455.1 |
| 4,924,599 | A | * | 5/1990 | Bubley | 34/4 |
| 5,750,192 | A | * | 5/1998 | Smith | 427/208 |
| 5,867,201 | A | * | 2/1999 | Ueda | 347/212 |
| 6,263,816 | B1 | * | 7/2001 | Codos et al. | 112/475.08 |
| 6,350,071 | B1 | * | 2/2002 | Conwell et al. | 400/118.2 |
| 6,428,862 | B1 | * | 8/2002 | Noguchi | 427/511 |

* cited by examiner

*Primary Examiner*—Henry Bennett
*Assistant Examiner*—Camtu Nguyen
(74) *Attorney, Agent, or Firm*—Orum & Roth

(57) ABSTRACT

A UV curing module for use with a label printer. UV curing lamps/radiation emitters are located to cover the label media path. The UV curing module may be integrated into the label printer or similar devices including a label applicator or a label rewinder.

19 Claims, 2 Drawing Sheets

UV CURING MODULE FOR LABEL PRINTER

This application claims the benefit of U.S. Provisional Application No. 60/287,842 filed May 1, 2001 and U.S. Provisional Application No. 60/283,113 filed Apr. 11, 2001.

BACKGROUND OF THE INVENTION

1. Field of the Invention

The invention relates generally to a UV curing device for use with a label printer and is specifically directed to a label applicator or label rewinder with integrated ultraviolet (UV) curing functionality.

2. Description of the Related Art

UV curing of printed images is normally associated with gravure, offset, screen or flexo-graphic printing processes and equipment.

The inventors are unaware of the previous application of integrated UV curing capability with a label applicator.

On demand printing, unlike the previous above listed printing processes provides a custom label or rolls of, for example, sequentially numbered labels on demand. With the capability of printing near or at the point of use, on demand printers are often used to provide unique labels for application in high abrasion and or chemical environments, for example in the engine compartment of automobiles. Some previous on demand printers for these applications have used protective over coverings and or labels having a layered structure. These solutions have added media and machine complexity and overall increased materials costs.

UV curable links are cured by exposure to UV light. The UV light initiates photo polymerization causing the ink's chemical conversion to a cross-linked polymer. Compared to conventional inks, UV curable inks create an image with improved abrasion and chemical resistance characteristics.

UV curable inks, UV curing apparatus, light guides, reflectors/concentrators for UV light, and label applicators are disclosed in detail in the following references hereby incorporated by reference:

U.S. Pat. No. 4,483,585 "Illuminating device having optical light guide formed as fibre bundle"

U.S. Pat. No. 4,924,599 "UV curing apparatus"

U.S. Pat. No. 5,832,362 "Apparatus for generating parallel radiation for curing photosensitive resin"

U.S. Pat. No. 4,052,280 "UV curing of polymerizable binders"

U.S. Pat. No. 5,521,392 "Light cure system with closed loop control and work piece recording"

U.S. Pat. No. 5,905,012 "Radiation curable toner particles"

DETAILED DESCRIPTION

Figure 1:
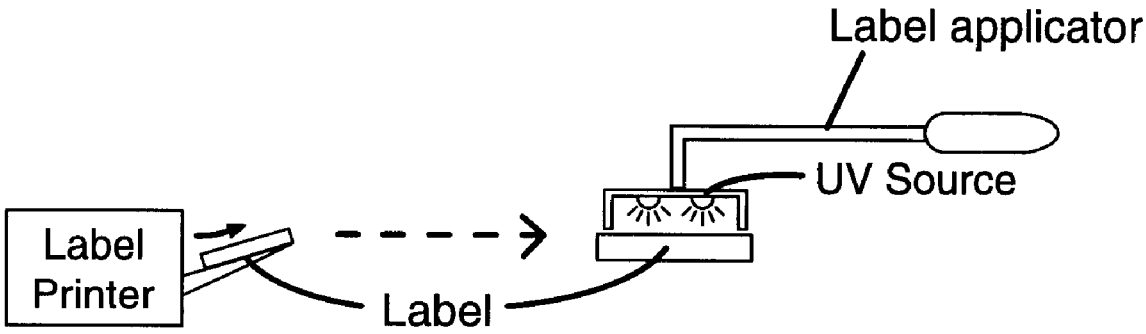
FIG. 1 is a schematic of a label applicator embodiment of the invention.
Figure 2:
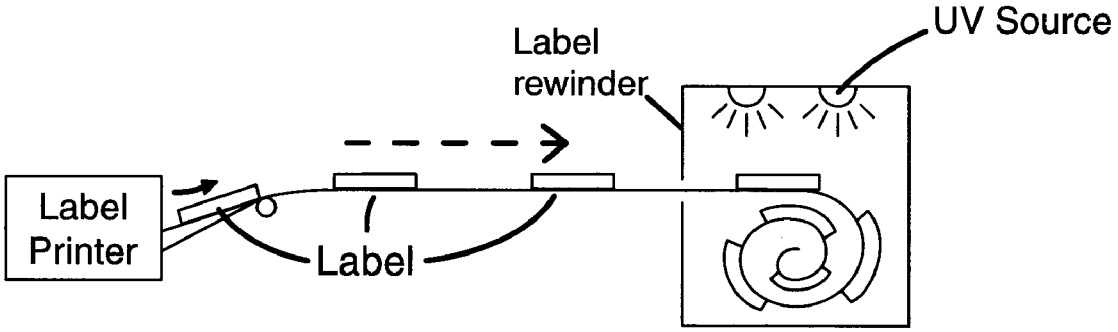
FIG. 2 id a schematic of a label rewinder embodiment of the invention.

A label applicator or rewinder unit is modified to include a UV curing device. In a label applicator embodiment, the UV curing element may be built into the head which picks up a label or it may be mounted over a belt drive that carries/transports the label from the printer to the applicator head. In a label rewinder embodiment, the UV curing element may be built into the rewinder enclosure or it may be mounted over a belt drive that carries/transports the label from the printer to the label rewinder. The UV energy from the UV curing device is focused upon the printed image such that the ink chemistry cures under UV radiation into a cross linked polymer.

The UV curing system or module would be user adjustable to match the light source wavelength to activate photo initiators in the ink chemistry.

The UV curing unit/module may be integrated into the on-demand label printer, applied to a stand alone off-line applicator unit for example designed to handle rolls of pre-printed labels, or it may be applied to a stand alone off-line label rewinder unit for example designed to rewind labels onto rolls of pre-printed labels as they exit the printer.

A label applicator or rewinder with a UV curing module may be either factory installed in new applicator or rewinder equipment or used installed as an add-on accessory. The lamp and/or power source may be positioned directly over the label path providing light energy focused on the label image as it passes or the lamp/power source may be located remote from the immediate path and the light energy directed from the lamp/power source through a fiber optic cable. Cooling of the UV lamp chamber may be via forced high-velocity air. The UV lamp and/or chamber may be equipped with a UV filter/shield to minimize or eliminate user exposure to the light energy. The light/power source of the unit may be selectable between different lamps and/or filters for the lamps to match the wavelength and light energy to the photo initiator chemistry in the inks. The lamp/energy power source may be a pulsed xenon flash lamp with the wavelength optimized by a circuit which allows for shifting current density.

Feedback to manipulate the lamp/power source output may be provided by a photo sensor control circuit depending upon the type of lamp/power source the photo sensor may be, for example, a fluorescent active optical sensor or a filtered photodiode sensor. The UV curing component may include a typical angled or parabolic curved reflector of metallic or dichromic material which may allow the adjustment of a focal point and intensity of the light energy. The lamp may be quartz, mercury vapor or other inert gas device. Lamp excitation may be through a conventional arc, radio frequency or microwave energy. Lamp and/or power source initiation may be by a label sensor or printer signal.

The integration of the UV curing function into the label applicator or rewinder allows the use of the device with the wide range of existing thermal transfer printers capable of using ultraviolet thermal transfer ribbons without adaptation or conversion (including additional hardware or software adjustments). In other embodiments the label applicator may also utilize other on demand printers such as inkjets, dot matrix, impact, or laser systems which are capable of utilizing inks which are photo polymerizable to a more durable state. The wide applicability of UV curing capability in an applicator allows the option of using UV curable print media without requiring a large capital investment.

We claim:

1. A UV curing device comprising:

means for curing UV curable ink arranged above a media flow path, wherein the means for curing is a UV curing module attached to a label applicator.

2. The UV curing device of claim 1 wherein the at least one lamp is activated upon a signal from a printer.

3. The UV curing device of claim 1 further comprising a photo sensor, wherein the at least one lamp is activated upon a signal from the photo sensor.

4. The UV curing device of claim 1 wherein the UV curing module comprises at least one lamp and a power source.

5. The UV curing device of claim 4 wherein the UV curing module further comprises at least one filter.

6. The UV curing device of claim 4 wherein the UV curing module further comprises a plurality of lamps and at least one activated lamp is selectable from the plurality of lamps to select a wavelength and a light energy.

7. The UV curing device of claim 5 wherein the UV curing module further comprises a plurality of filters and at least one filter is selectable from the plurality of filters to select a wavelength and a light energy.

8. The UV curing device of claim 4 wherein the at least one lamp is selected from the group consisting of quartz lamp, mercury vapor lamp, pulsed xenon flash lamp and inert gas lamp.

9. The UV curing device of claim 4 wherein the UV module further comprises a UV shield.

10. The UV curing device of claim 1 wherein a label applicator is an offline applicator.

11. the UV curing device of claim 4 wherein the at least one lamp is a pulsed xenon flash lamp.

12. The UV curing device of claim 1 wherein the UV curing module further comprises a reflector, said reflector is selected from the group consisting of angled, parabolic and curved and said reflector is made of a material selected from the group of metallic and dichromic materials.

13. The UV curing device of claim 4 wherein the at least one lamp and the power source are located remote from the media flow path and light energy is directed from the lamp through a fiber optic cable.

14. The UV curing device of claim 10 wherein the label applicator is capable of applying labels from a roll of preprinted labels.

15. The UV curing device of claim 4 wherein the UV curing module further comprises a cooling element.

16. The UV curing device of claim 15 wherein the cooling element utilizes forced high-velocity air.

17. the UV curing device of claim 11 wherein the wavelength of light emitted by the lamp is optimized by a circuit which permits shifted current density.

18. The UV curing device of claim 17 wherein the UV module further comprises a photo sensor.

19. A The UV curing device of claim 9 wherein the photo sensor is selected from the group consisting of a fluorescent active optical sensor and a filtered diode sensor.

* * * * *